US012241243B2

(12) United States Patent
Elsinger et al.

(10) Patent No.: US 12,241,243 B2
(45) Date of Patent: Mar. 4, 2025

(54) SINK AND METHOD OF PROVIDING A SINK

(71) Applicant: BLANCO GMBH + CO KG, Oberderdingen (DE)

(72) Inventors: Bernd Elsinger, Sulzfeld (DE); Detlef Schoen, Freiburg (DE); Simone Silvery, Walzbachtal (DE); Michael Osterroth, Waghäusel (DE)

(73) Assignee: BLANCO GMBH + CO KG, Oberderdingen (DE)

( * ) Notice: Subject to any disclaimer, the term of this patent is extended or adjusted under 35 U.S.C. 154(b) by 74 days.

(21) Appl. No.: 17/779,255

(22) PCT Filed: Nov. 26, 2020

(86) PCT No.: PCT/DE2020/200104
§ 371 (c)(1),
(2) Date: May 24, 2022

(87) PCT Pub. No.: WO2021/104585
PCT Pub. Date: Jun. 3, 2021

(65) Prior Publication Data

US 2022/0403636 A1 Dec. 22, 2022

(30) Foreign Application Priority Data

Nov. 26, 2019 (DE) ..... 10 2019 218 293.3

(51) Int. Cl.
*E03C 1/33* (2006.01)
*E03C 1/182* (2006.01)

(52) U.S. Cl.
CPC ..... *E03C 1/33* (2013.01); *E03C 1/182* (2013.01)

(58) Field of Classification Search
CPC ..... E03C 1/18; E03C 1/14
(Continued)

(56) References Cited

U.S. PATENT DOCUMENTS

D313,068 S 12/1990 Kohler, Jr. et al.
D353,652 S 12/1994 Dannenberg
(Continued)

FOREIGN PATENT DOCUMENTS

EP 2 681 367 4/2017

OTHER PUBLICATIONS

International Search Report issued Mar. 4, 2021 in International (PCT) Application No. PCT/DE2020/200104 (with English translation).

(Continued)

*Primary Examiner* — Erin Deery
(74) *Attorney, Agent, or Firm* — Wenderoth, Lind & Ponack, L.L.P.

(57) ABSTRACT

A sink is for installation in a piece of sanitary furniture. The sink includes: a surface; a front apron; a side apron; a first edge in a first transition area from the surface to the front apron; a second edge in a second transition area from the surface to the side apron; and a third edge in a third transition area from the front apron to the side apron, The second edge has a first edge area and a second edge area. A radius of the first edge area of the second edge is larger than a radius of the second edge area of the second edge. The first edge area of the second edge is adjacent to the third transition area. The first edge area of the second edge merges continuously into the third edge. The third edge merges continuously into the first edge.

16 Claims, 4 Drawing Sheets

(58) Field of Classification Search
USPC .... D23/272–274, 284, 286, 292–293.1, 303, D23/308
See application file for complete search history.

(56) References Cited

U.S. PATENT DOCUMENTS

| | | | | | |
|---|---|---|---|---|---|
| D358,457 | S | | 5/1995 | Dannenberg | |
| D494,665 | S | | 8/2004 | Herbeau | |
| D601,679 | S | * | 10/2009 | Soulier | D23/293.1 |
| D622,824 | S | * | 8/2010 | Miklosi | D23/284 |
| D670,366 | S | | 11/2012 | Booth et al. | |
| 9,173,487 | B2 | * | 11/2015 | Booth | E03C 1/33 |
| 10,422,115 | B2 | | 9/2019 | Chong et al. | |
| 2006/0195981 | A1 | * | 9/2006 | Yemini | E03C 1/18 134/201 |

OTHER PUBLICATIONS

Written Opinion of the International Searching Authority issued Mar. 4, 2021 in International (PCT) Application No. PCT/DE2020/200104 (with English translation).

* cited by examiner

SINK AND METHOD OF PROVIDING A SINK

BACKGROUND OF THE INVENTION

1. Field of the Invention

The invention relates to a sink, in particular an apron sink as a sink, for installation in a piece of sanitary furniture, in particular a piece of kitchen furniture or the like, wherein the sink comprises a surface, at least one side apron and one front apron, wherein a first edge is formed in a first transition area from the surface to the at least one front apron, and wherein a second edge is formed in a second transition area from the surface to the at least one side apron.

The invention further relates to a method of providing a sink for sunken and flush-mounted installation, comprising the steps of:

- Manufacture of a sink having a surface, at least one side apron and one front apron,
- Forming a first edge in a first transition area from the surface to the at least one front apron, and
- Forming a second edge in a second transition area from the surface to the at least one side apron.

Although this invention can generally be applied to any sink, this invention is described with respect to an apron sink as a sink.

2. Description of the Related Art

Apron sinks as sinks have already become known in many ways and are used for washing fruit and vegetables, washing dishes or the like. Apron sinks can be integrated into a kitchen countertop in a variety of ways. I.e., on the one hand, apron sinks can be disposed beneath a matching recess of the kitchen countertop as a so-called sunken sink, on the other hand, the apron sinks can also be arranged flush with the surface of the countertop. Likewise, a design is also possible in which the apron sink is inserted into a recess from above and its circumferential rim rests on the surface of the countertop.

If the apron sink is installed under the kitchen countertop, it is also possible to be only partially sunken, which means that parts of the apron sink protrude forward in parallel to the surface of the kitchen countertop, i.e. to the front side of the kitchen countertop. In this case, to protect the frontal and lateral protruding areas of the apron sink, it is common to provide them with side aprons and a front apron.

From EP 2 680 722 B1 and U.S. Pat. No. 10,151,085 B2, respectively, an apron sink arrangement has become known with an apron sink, to which a generally U-shaped apron for forming front and partial side aprons is glued onto a matching bar of the apron sink or matching projections. The disadvantage is that the production and implementation is costly and the apron sink can only be installed as a drop-in sink. In other words, the apron sink may be extremely difficult to adapt to other types of installation, such as sunken or flush-mount installation.

From EP 2 681 367 B1 an apron sink having a frontal and two side aprons is known. In this case, the surface area of the edge encompassing the apron sink in the area of the front and side aprons is wider than the rest of the rim encompassing the apron sink. The disadvantage is that the apron sink can be integrated only as undermount of a countertop.

It is also extremely difficult to adapt to other types of installation, such as sunken or flush-mount installation.

SUMMARY OF THE INVENTION

Therefore, this invention addresses the problem of providing a sink and a method for providing a sink, the manufacture or implementation of which is simple and inexpensive. A further object of this invention is to provide a sink, which can be flexibly adapted to different types of installation. This invention further addresses the problem of providing an alternative sink and an alternative method for providing a sink.

In one embodiment, this invention solves the problems mentioned above in a sink, in particular an apron sink as a sink, for installation in a piece of sanitary furniture, in particular a piece of kitchen furniture or the like, wherein the sink comprises a surface, at least one side apron and one front apron, wherein a first edge is formed in a first transition area from the surface to the at least one front apron, and wherein a second edge is formed in a second transition area from the surface to the at least one side apron, in that the second edge has at least one first and one second edge area of different sizes, wherein the first edge area is disposed adjacent to a third transition area from the at least one front apron to the one side apron, and in that the first edge area of the second edge is formed to merge continuously into the first edge, wherein the first edge area of the second edge is smaller than the first edge, wherein the size of the first and/or second edge is determined on the basis of a radius of the transition from the surface to the at least one side apron and/or from the surface to the front apron.

In a further embodiment, this invention solves the problems listed above using a method for providing a sink for sunken and flush-mount installation, comprising the steps:

- Manufacturing of a sink having a surface, at least one side apron and one front apron,
- Forming a first edge in a first transition area from the surface to the at least one front apron, and
- Forming a second edge in a second transition area from the surface to the at least one side apron, in that the second edge has at least one first and one second edge area of different sizes, wherein the first edge area is disposed adjacent to a third transition area from the at least one front apron to one side apron, and in that the first edge area of the second edge is formed to merge continuously into the first edge, wherein the first edge area of the second edge is smaller than the first edge, wherein the size of the first and/or second edge is determined on the basis of a radius of the transition from the surface to the at least one side apron and/or from the surface to the front apron.

One of the advantages achieved in this way is providing a sink that can be used directly for sunken installation, while also being easily adaptable for flush-mount, high-quality installation into a countertop. In addition, particularly simple production is possible, as the design of the edges allows easy demolding of sinks in the form of cast parts from the casting mold. Another advantage of this is that the radius can be used to easily determine the size of the edge and to easily manufacture the edge. In addition, sharp edges are avoided.

The term "continuous" with regard to the transition between two edges and/or from the front apron to the side apron, from the front apron to the surface and/or from the side apron to the surface is defined as any continuous, that is, uninterrupted, transition. In particular, the term "continuous" includes any transition having a constant curvature, for instance with a defined radius, or having a non-constant curvature, for instance by means of one or more splines, chamfered edges, conical fillets or the like.

Further features, advantages and further embodiments of the invention are described below or are disclosed in that way.

According to a preferred embodiment, the angle between the at least one side apron and the front apron and/or the angle between the surface and the side apron and/or front apron ranges from 80 degrees to 100 degrees, preferably from 85 degrees to 95 degrees, in particular is roughly 90 degrees. This makes for a high level of visual appeal while continuing to be easy to manufacture.

According to a further preferred embodiment, the third transition area from the at least one front apron to the at least one side apron is designed to be continuous, in particular curved. This avoids sharp edges, which reduces the risk of injury on the one hand and the likelihood of damage to the sink on the other.

According to a further preferred embodiment, the third transition area from the at least one front apron to the at least one side apron is provided with a radius of curvature which is at least 3 times, in particular more than 6 times, preferably more than 10 times the size of the first edge. The advantage of this is that the radius of curvature is sufficiently large compared to the size of the first edge to avoid the risk of damage and at the same time to ensure easy demoldability of cast sinks from the casting mold.

According to a further preferred embodiment, the ratio of the radii of the first edge and the first edge area of the second edge is at least 1.5, preferably at least 2.0, in particular at least 2.5, preferably at least 3, in particular 4, 4.5 or 5. This makes for a particularly simple flush-mount installation.

According to a further preferred embodiment, the second edge has at least two first edge areas, each of which is arranged adjacent to different side aprons. This enables a symmetrical arrangement of the first two edge areas, which simplifies production and creates a high level of visual appeal.

According to a further preferred embodiment, the ratio of the radii of the first edge area and the second edge area of the second edge is at least 2.5, preferably at least 5.0, in particular at least 7.5, preferably at least 9, in particular 10, 11 or 12. This makes it particularly easy to manufacture, since a smaller radius, which is more difficult to manufacture compared to a larger radius, only has to be provided in the first edge area.

According to a further preferred embodiment, the ratio of the lengths of the first and the second edge areas along the surface is at least 1.5, preferably at least 2.5, in particular at least 3, preferably at least 4, in particular 5 or more. This further simplifies manufacturability, as a small-radius edge only needs to be provided in a small area.

According to a further preferred embodiment, the second edge area of the second edge is formed as an edge having the radius 0. This makes it particularly easy to manufacture, for instance by milling.

According to a further preferred embodiment, the sink is integrally formed. The advantage thereof is easy integration, as there is no need for time-consuming assembly of various parts of the sink.

According to a further preferred embodiment, the surface and/or the side apron have a recess in parallel to the surface in the region of the second edge area. This makes for an even easier flush-mount installation, as a user perceives a recess as less disturbing than, for instance, a protrusion of the same type or size, even if these are in the millimeter range.

According to a further preferred embodiment, the at least one side apron is designed to extend only partially along a side wall of the sink. This avoids unnecessary restrictions during flush-mount installation owing to the side apron and reduces the overall installation space of the sanitary equipment.

According to a further preferred embodiment of the process, the sizes of the first and second edge areas are manufactured such that the ratio of the radii of the first edge area and the second edge area is at least 2.5, preferably at least 5.0, in particular at least 7.5, preferably at least 9, in particular 10, 11 or 12. This makes it particularly easy to manufacture, since a smaller radius, which is more difficult to manufacture smaller and equal to a larger radius, only has to be provided in the first edge area.

According to a further preferred embodiment of the process, in the area of the second edge area, the surface and/or at least one side apron is/are produced in parallel to the surface having a recess. For instance, a side apron parallel to the surface can thus be provided with a recess, while a side apron located on another side of the sink can be provided with a protrusion extending in parallel to the surface. The recess makes for an even easier flush-mount installation, as a user perceives a recess as less disturbing than, for instance, a protrusion of the same type or size, even if these are in the millimeter range.

According to a further preferred embodiment of the method, the sink is produced with the second edge area of the second edge, with the exception of the first edge and the first edge area of the second edge, and the second edge area thus produced is milled and/or ground circumferentially to form an edge. This reduces the overall installation space and weight and optimizes the sink for flush-mount installation.

Further important features and advantages of the invention are described in more detail in the dependent claims, in the drawings, and in the accompanying figure description based on the drawings.

It goes without saying that the features mentioned above and those to be explained below can be used not only in the combination indicated in each case, but also in other combinations or on their own, without departing from the scope of this invention.

BRIEF DESCRIPTION OF THE DRAWINGS

Preferred embodiments and embodiments of this invention are shown in the drawings and will be explained in more detail in the following description, wherein identical reference signs refer to identical or similar or functionally identical components or elements.

In the Figures

DETAILED DESCRIPTION OF THE INVENTION

Figure 1:
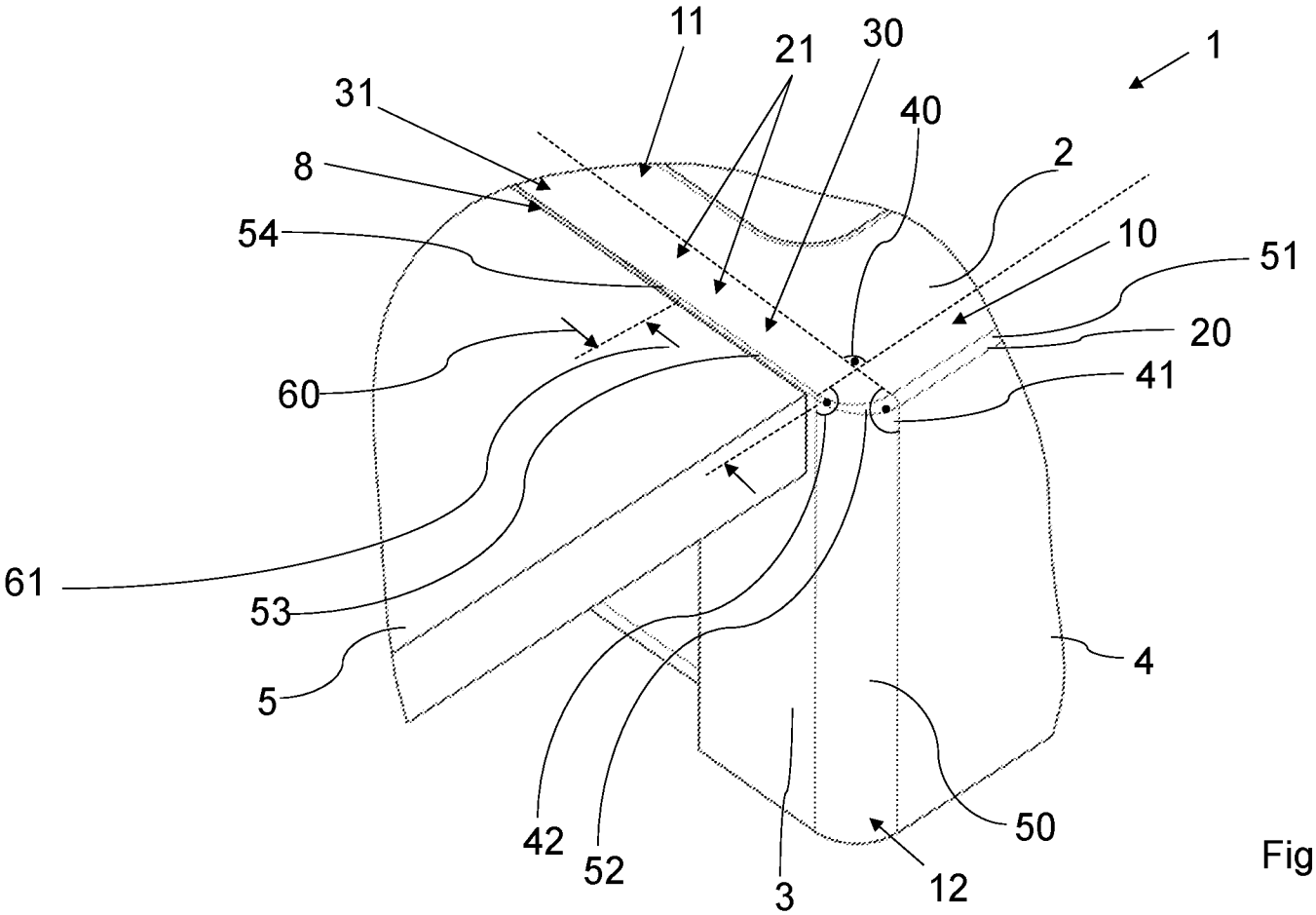
FIG. 1 shows a three-dimensional schematic view of a section of a front corner region of an apron sink according to an embodiment of this invention.

FIG. 1 shows a three-dimensional schematic view of a section of a front corner region of an apron sink according to an embodiment of this invention.

In detail, FIG. 1 shows a section of a left front corner of an apron sink 1. The apron sink 1 has a flat circumferential surface 2 in the form of a wide protrusion, which merges into a front apron 4 in the front area and into a side apron 3 at the side. The planes of front apron 4 and side apron 3, surface 2 and side apron 3, and surface 2 and front apron 4 each form an angle 40, 41, 42 of about 90 degrees. The left side of FIG. 1 shows a section of a countertop 5, in which the apron sink is installed flush with the surface. Between the surface 2, which is largely horizontal in the installation position, and the front apron 4, a first transition area 10 is formed having a first edge with a first radius 51 such that a rounded transition is formed from the surface 2 to the front apron 4. For instance, the first radius 51 can be in the range of 1.5 mm to 4 mm. Furthermore, a second transition area 11 with a second edge 21 is formed from the surface 2 to the side apron 3 shown. This second edge 21 has two sections 30, 31, which have a different radius 54, 53, such that in each case there is a transition from the surface 2 to the side apron 3. The radius 53 can be formed to be 0.5 mm to 2.5 mm, for instance.

For instance, the length 60 of the section 30 along the surface 2 may be 2 mm to 100 mm, preferably 50 mm to 70 mm. The length 61 of the second section 31 is more than five times that of the length of the first section 30 of the second edge 21. In this case, the radius 51 between the surface 2 and the front apron 4 is larger than the radius 54 of the second section 31 of the second edge 21, but larger than the radius 53 of the first section 30 of the second edge 21 in the two front corners of the apron sink 1, that is, in the corners adjacent to the front apron 4. The section 31 with the radius 54 has a radius of 0 mm, in other words an edge is formed between the side apron 3 and the surface 2. Here, not only the second transition area 11 is milled, but largely the remaining areas of the left and right side aprons and the rear panel 6 are milled except for the sections 30 and the front apron 4.

Along the area of the surface 2 extending from the bottom right to the top left in FIG. 1, the radii 54, 53 of different sizes merge at least steadily, in particular continuously. Finally, there is also a rounded transition with radius 50 in the third transition area 12 from the front apron 4 to the side apron 3. For instance, the radius 50 can be between 5 mm and 200 mm, preferably between 7.5 mm and 100 mm, in particular between 10 mm and 40 mm, preferably between 10 mm and 20 mm. Furthermore, the transition from the first radius 51 to the radius 53 of the second edge 21 with a third edge 52, which is a continuously changing radius, takes place in the third transition area 12.

Figure 2:
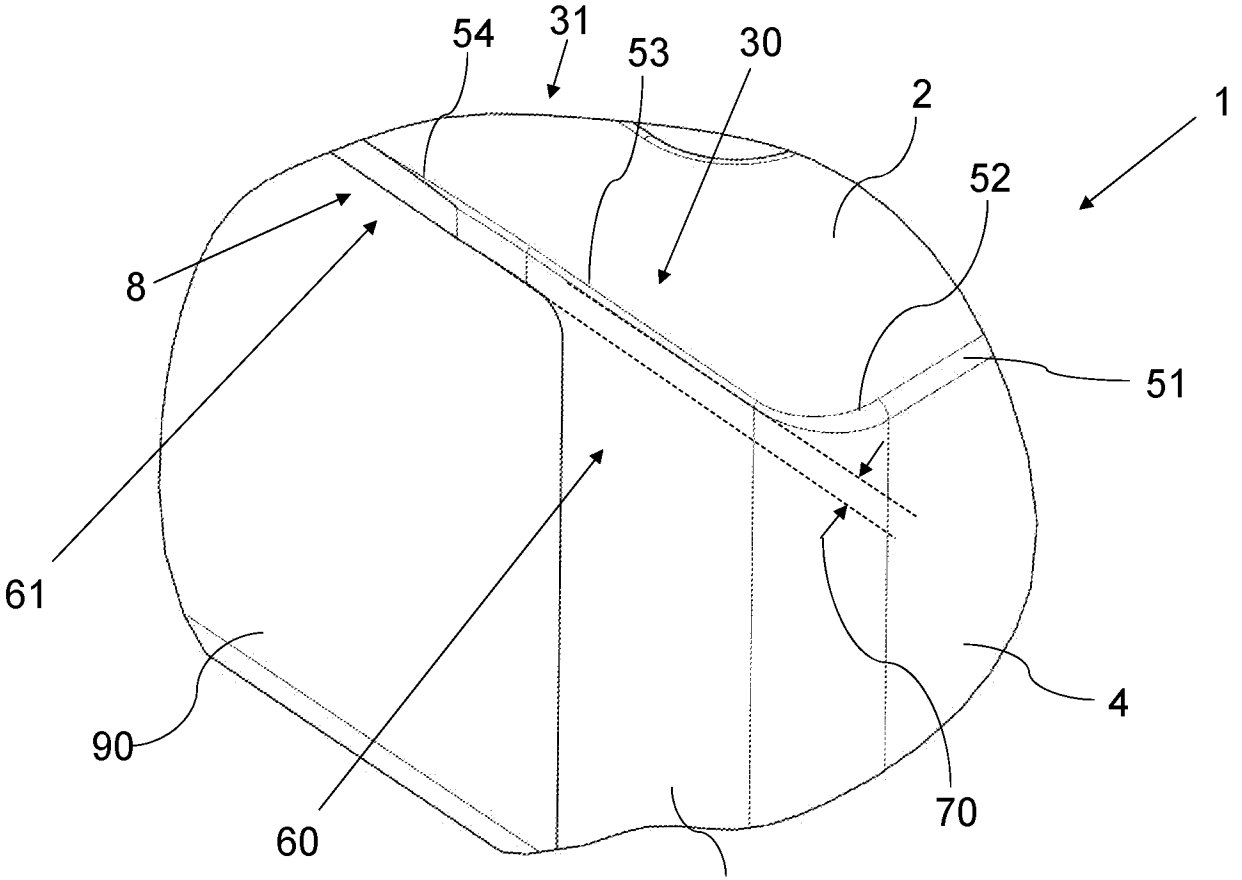
FIG. 2 shows a three-dimensional schematic view of a section of the front corner area of the apron sink of FIG. 1.
Figure 3:
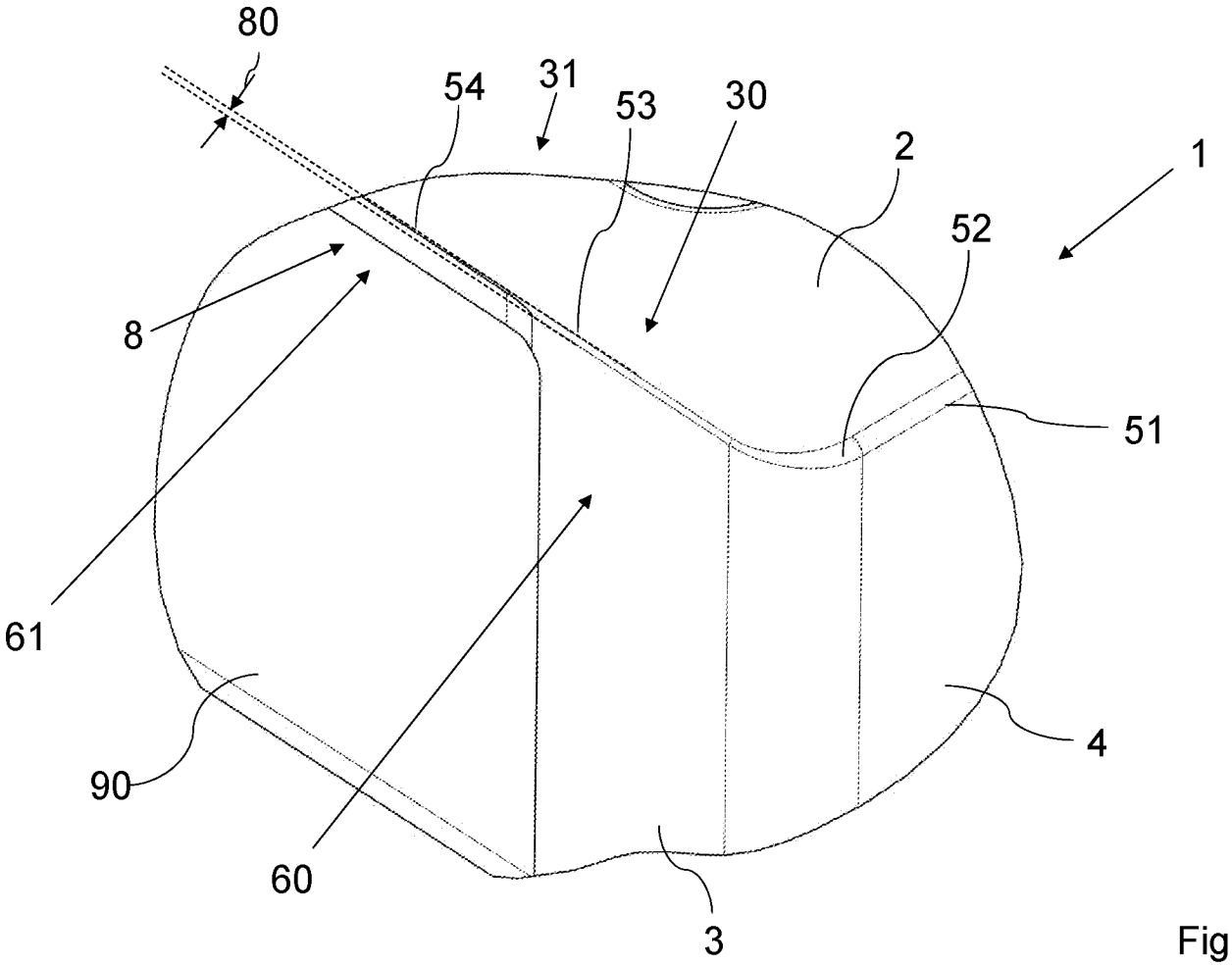
FIG. 3 shows a three-dimensional schematic view of a section of the front corner region of an apron sink according to an embodiment of this invention.

FIGS. 2 and 3 each show three-dimensional schematic view of a section of the front corner region of an apron sink according to one embodiment of this invention.

In detail, FIG. 2 shows a three-dimensional view according to FIG. 1 without the countertop 5, wherein parts of the side apron 3 in the area 90 have been removed, for instance by milling, and at the same time the radius 54 of the second section 31 of the second edge 21 has been formed to be an edge 8 (radius 0 mm). A "hard" transition has been created between the two radii 53 and 54 of the two sections 30, 31 of the second edge 21, that is, the transition is steady but not continuous.

In the illustration of FIG. 2, the section 31, into which the edge 8 has been milled, has a protrusion 70 with respect to the section 30, which has not been milled, i.e. the side apron 3 is produced in this area with a correspondingly large material thickness to allow the protrusion 70 on the one hand, and the edge 8 in the section 31 on the other hand.

Alternatively, in a further embodiment of FIG. 3, it is also possible to provide a recess 80 instead of the protrusion 70, i.e. the remaining part of the side apron 3 in the area 30 protrudes accordingly. This offers further advantages for a flush-mount installation of the apron sink 1.

Figure 4:
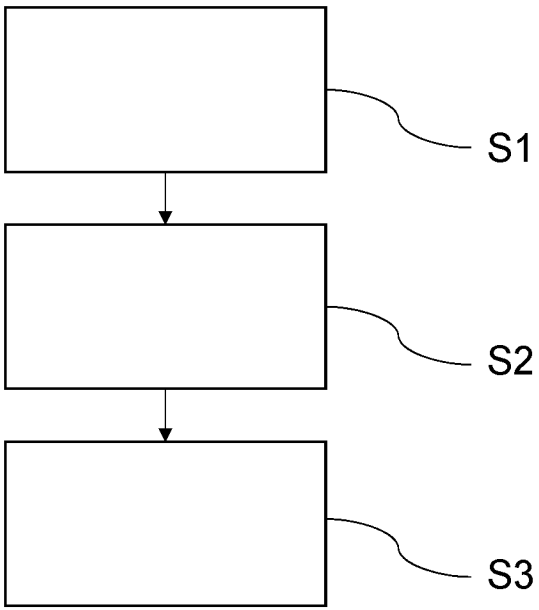
FIG. 4 shows steps of a method system according to an embodiment of this invention.

FIG. 4 shows steps of a method according to one embodiment of this invention.

In detail, FIG. 4 shows steps of a process for providing a sink for a sunken or flush-mount installation.

The method comprises the steps outlined below.

In a first step S1, a sink with a surface, at least one side apron and one front apron is manufactured.

In a further step S2, a first edge is formed in a first transition area from the surface to the at least one front apron.

In a further step S3, a first edge is formed in a second transition area from the surface to the at least one side apron.

At least one of the steps S1-S3 is performed in that the second edge has at least one first and one second edge area of different sizes, wherein the first edge area is disposed adjacent to a third transition area from the at least one front to one side apron, and in that the first edge area of the second edge is formed to merge continuously into the first edge, wherein the first edge area of the second edge is smaller than the first edge, and wherein the size of the first and/or second edge is determined on the basis of a radius of the transition from the surface to the at least one side apron and/or from the surface to the front apron.

In summary, at least one of the embodiments of the invention has at least one of the advantages listed below:

- Simple and inexpensive to manufacture,
- High flexibility with regard to different installation types, in particular flush-mount installation and sunken installation,
- High level of visual appeal,
- Easy demoldability from a casting mold when the sink is manufactured as a cast part.

Although this invention has been described with reference to preferred exemplary embodiments, it is not limited thereto and can be modified in a variety of ways.

LIST OF REFERENCE NUMERALS

1 Apron sink
2 Surface
3 Side apron
4 Front apron
5 Countertop
6 Rear panel
8 Edge
10 First transition area
11 Second transition area
12 Third transition area
20 First edge
21 Second edge
30 First edge area/section
31 Second edge area/section
40, 41, 42 Angle
50 Radius of curvature
51, 53, 54 Radius edge
52 Third edge
60, 61 Length
70 Projection
80 Recess
90 Area

The invention claimed is:

1. A sink for installation in a piece of sanitary furniture, the sink comprising:

a surface;

a front apron;

a side apron;

a first edge in a first transition area from the surface to the front apron;

a second edge in a second transition area from the surface to the side apron; and a third edge in a third transition area from the front apron to the side apron, wherein:

the second edge has a first edge area and a second edge area;

a radius of the first edge area of the second edge is larger than a radius of the second edge area of the second edge;

the first edge area of the second edge is adjacent to the third transition area;

the first edge area of the second edge merges continuously into the third edge;

the third edge merges continuously into the first edge;

the first edge area of the second edge is smaller than the first edge; and a size of the first edge corresponds to a radius of the first transition area, or a size of the second edge corresponds to a radius of the second transition area.

2. The sink according to claim 1, wherein:

an angle between the side apron and the front apron is from 80 degrees to 100 degrees;

an angle between the surface and the front apron is from 80 degrees to 100 degrees; or an angle between the surface and the side apron is from 80 degrees to 100 degrees.

3. The sink according to claim 1, wherein the third transition area is continuous.

4. The sink according to claim 3, wherein a radius of the third transition area is at least three times a radius of the first edge.

5. The sink according to claim 1, wherein a ratio of a radius of the first edge to the radius of the first edge area of the second edge is at least 1.5.

6. The sink according to claim 1, wherein:

the side apron is one of at least two side aprons;

the first edge area of the second edge is one of at least two first edge areas of the second edge; and the at least two first edge areas of the second edge are adjacent to the at least two side aprons, respectively.

7. The sink according to claim 1, wherein a ratio of the radius of the first edge area of the second edge to the radius of the second edge area of the second edge is at least 2.5.

8. The sink according to claim 1, wherein a ratio of a length of the first edge area of the second edge along the surface to a length of the second edge area of the second edge along the surface is at least 1.5.

9. The sink according to claim 1, wherein the radius of the second edge area of the second edge is zero.

10. The sink according to claim 1, wherein the sink is integrally formed.

11. The sink according to claim 1, wherein the surface has a recess extending in parallel to the surface in the second edge area of the second edge.

12. The sink according to claim 1, wherein the size of the first edge corresponds to the radius of the first transition area, and the size of the second edge corresponds to the radius of the second transition area.

13. The sink according to claim 1, wherein the third transition area is curved.

14. The sink according to claim 1, wherein the side apron has a recess extending in parallel to the surface in the second edge area of the second edge.

15. The sink according to claim 1, wherein the side apron extends only partially along a side wall of the sink.

16. The sink according to claim 1, wherein:

the surface has a recess extending in parallel to the surface in the second edge area of the second edge;

the side apron has a recess extending in parallel to the surface in the second edge area of the second edge; and the side apron extends only partially along a side wall of the sink.

* * * * *